United States Patent [19]

Zeller et al.

[11] Patent Number: 4,657,326

[45] Date of Patent: Apr. 14, 1987

[54] CURRENT CONDUCTION CONNECTOR FOR THE ELECTRICAL CONNECTION OF GAS BAG COLLISION PROTECTION INSTALLATION

[75] Inventors: Gregor Zeller, Aschaffenburg; Helmut Bonn, Haibach, both of Fed. Rep. of Germany

[73] Assignee: Petri AG, Fed. Rep. of Germany

[21] Appl. No.: 835,282

[22] Filed: Mar. 3, 1986

[30] Foreign Application Priority Data

Mar. 1, 1985 [EP] European Pat. Off. ..... 85102304.4

[51] Int. Cl.[4] ..... H01R 39/02

[52] U.S. Cl. ..... 339/3 S; 339/5 M

[58] Field of Search ..... 339/2 L, 3 R, 3 S, 5 M, 339/8 R, 8 RL, 17 F

[56] References Cited

U.S. PATENT DOCUMENTS 3,525,536 8/1970 Pruneski ..... 339/3 S 3,763,455 10/1973 Confer et al. ..... 339/3 S

FOREIGN PATENT DOCUMENTS 3041257 6/1982 Fed. Rep. of Germany ..... 339/8 R

*Primary Examiner*—Eugene F. Desmond

*Attorney, Agent, or Firm*—Robert J. Koch

[57] ABSTRACT

Current conducting connector for the electric connection of a gas bag collision protection device located in the bowl of a steering wheel of an automotive vehicle. A current conductor having a conducting strip, arranged in several concentric windings in a fixedly mounted housing surrounding a steering shaft or steering wheel hub. The ends of the conductor are connected by an inner and an outer connecting element. The inner connecting element is arranged on a core surrounding the steering shaft or the steering wheel hub and rotates with the steering wheel. The outer connecting element has a pivoting nipple held in a pivot bearing formed in the housing and surrounding an opening in the wall of the housing. The current conductor is introduced outside the housing axially into the pivoting nipple and lead out inside the housing radially from the pivoting nipple. The pivot bearing is formed by a sleeve arranged in the area of the wall of the housing and projecting through the bottom of the housing, the sleeve being provided with a slot forming a lateral opening toward the inside of the housing and of a width sufficient to permit the rotation of the pivoting nipple over a predetermined angle.

11 Claims, 5 Drawing Figures

CURRENT CONDUCTION CONNECTOR FOR THE ELECTRICAL CONNECTION OF GAS BAG COLLISION PROTECTION INSTALLATION

BACKGROUND OF THE INVENTION

1. Field of the Invention

The invention relates to a current conduction connector for the electrical connection of a gas bag collision protection installation arranged in the steering wheel bowl of an automative vehicle, more particularly a current conductor formed essentially by a conducting strip, located in several concentric windings in a fixedly mounted housing surrounding the steering wheel hub or steering shaft. The ends of said conductor are connected to an inner and an outer connector element. The inner element is connected to a core surrounding the steering shaft or the steering wheel hub and rotating with the steering wheel. The outer connector element is located in the area of the outer wall of the housing.

2. Description of the Related Art

In the current conduction connector of DE-OS No. 30 09 109.9, the ends of the current conducting line are held in a terminal clamp arranged fixedly in the housing or the core. This has been found essentially satisfactory. There exists, however, the risk that by the movements of the steering wheel into its terminal position a bending moment is always applied to the conducting strip, in particular in the area of the terminal clamp exposed by the rotation of the steering wheel, leading to the bending of the conducting strip that is returned by the back rotation of the steering wheel into its other terminal position. In the case of an adequate number of stress reversals, the constantly recurring alternating bending movements produced in this manner induce the risk of the fracture of the conductor interfering with the operation of the gas bag collision protection device.

SUMMARY OF THE INVENTION

It is an object of the present invention to provide a conducting connector whereby the danger of a fracture of the conductor is safely excluded even in the case of an unlimited number of maximum steering wheel rotations. The invention comprises at least an outer, but preferably both outer and inner conducting elements, comprising a pivoting nipple held in a pivot bearing formed in the housing and surrounding an opening in the wall of said housing. The current conductor is introduced outside the housing axially in the pivoting nipple and is lead out from the pivoting nipple radially inside the housing.

The invention provides a conducting connector capable of following all of the movements resulting from the rotation of the steering wheel without the application of a bending movement to the conductor itself so that the risk of alternating bending causing the conductor to fracuture is avoided. The conducting connector may therefore be exposed to an unlimited number of stress reversals without the expectation of interference with the operation of the gas bag collision protection device.

In one embodiment of the invention, the current conductor may comprise a one-piece conducting strip protruding through the nipple, bent into a loop forming an angle of approximately 90° and enclosed in the area of loop by the nipple. The embodiment of the invention makes a particularly simple mode of producing the conducting connector while insuring a durable electric connection possible as no screwing or soldering operations are required to establish the galvanic connection since it is only necessary to bend the conductor into a loop and insert the loop into the injection mold to produce the nipple. The one-time stressing of the conductor while bending it into a loop presents no danger of the fracture of the conductor, as no further stressing is to be feared in view of the embedding of the conductor in the nipple. The conductor or conducting strip may, for example, be a ribbon cable or one or more conductin wires. In a further corresponding embodiment, the current conductor may be formed inside the housing by a conducting strip and outside the housing by a round conductor, connected with each other by means of a connecting element in a position including an angle of approximately 90°, wherein the connecting element is surrounded by the pivoting nipple.

The pivot bearing is formed conveniently by a sleeve arranged in the area of the wall of the housing and projecting through the bottom of said housing, said sleeve being provided with a slot representing a lateral opening toward the inside of the housing and having a width permitting the rotation of the pivoting nipple by a predetermined angle, wherein the pivoting nipple is provided with a circumferential groove and the pivot bearing with a shoulder projection projecting into said groove. In this manner, a secure holding of the pivot bearing is obtained while providing the necessary freedom of rotation.

BRIEF DESCRIPTION OF THE DRAWING:

The invention is illustrated in the drawing by means of an example. In the drawing.

DETAILED DESCRIPTION OF THE PREFERRED EMBODIMENT

Figure 1:
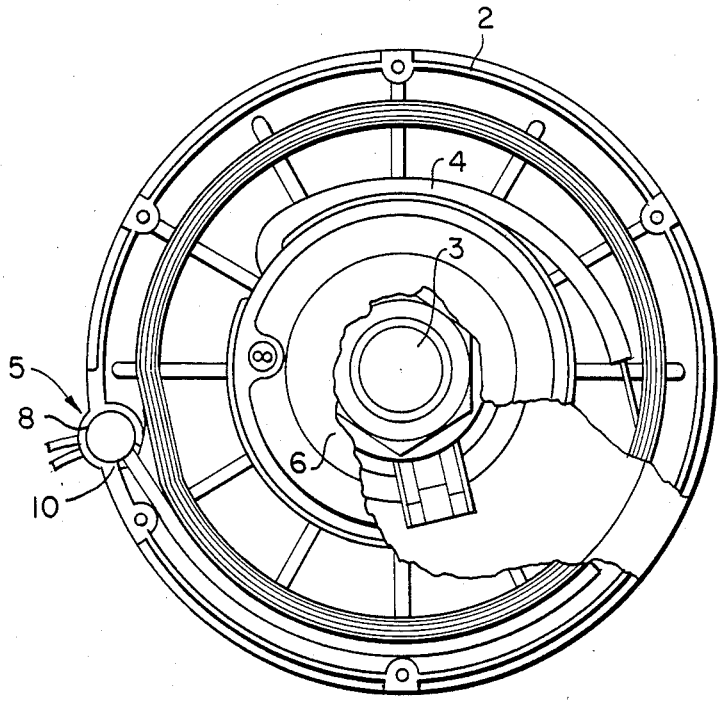
FIG. 1 shows a view of the current conducting connector according to the invention.
Figure 2:
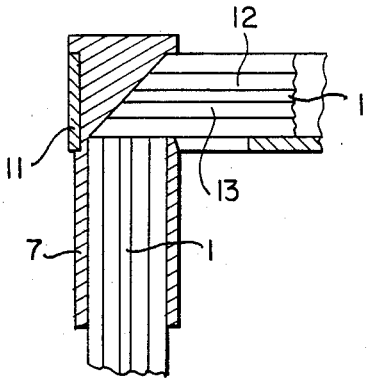
FIG. 2 shows the bearing nipple of a current conducting connector in section.
Figure 3:
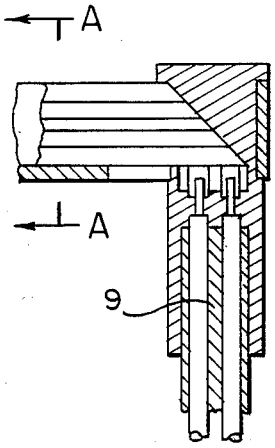
FIG. 3 shows an alternataive embodiment of a bearing nipple again in section.
Figure 4:
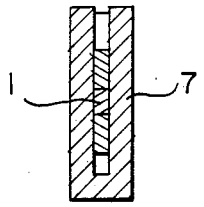
FIG. 4 shows a section along A—A of FIG. 3.
Figure 5:
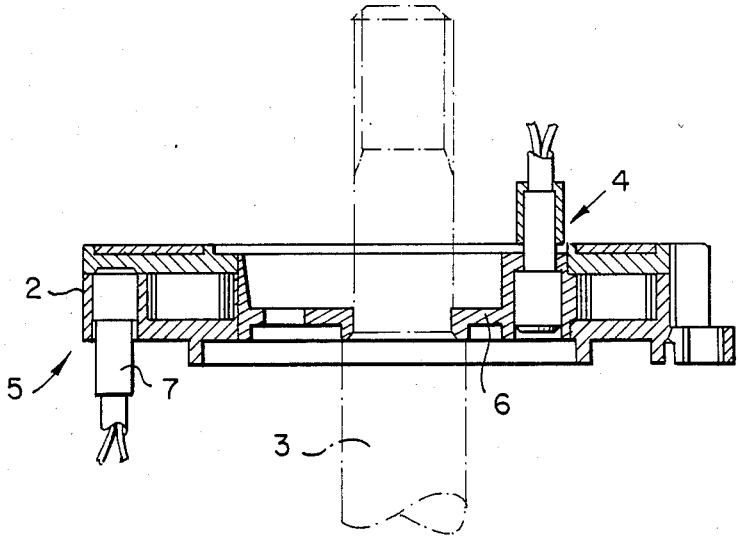
FIG. 5 shows a side view of an embodiment according to the invention.

The current conducting connector shown in the drawing for the electrical connection of a gas bag collision protection device located in the bowl of the steering wheel consists essentially of a current conductor formed by a conducting strip 1 having conductors 12 and 13 arranged in a plurality of concentric windings in fixedly mounted housing 2 surrounding the steering shaft or steering wheel hub 3 and the ends whereof are connected with an inner and an outer connecting elements 4 and 5, respectively, with the inner connecting element being arranged on a core 6 surrounding the steering shaft or steering wheel hub and rotating with the steering wheel and the outer connecting element arranged in the area of the outer wall of the housing 2. The outer connecting element 5 is formed by a pivoting nipple 7, held in a pivot bearing 8 formed in the housing 2 and surrounding an opening of the wall of the housing, with the current conductor being introduced outside the housing axially into the pivoting nipple 7 and lead out inside the housing 2 radially from the pivoting nipple. In the case of the embodiment shown in FIG. 2, the current conductor consists of a single-piece conducting strip 1 protruding through the nipple and bent into a loop foring an angle of approximately 90', and surrounded in the area of the loop by the nipple 7, while in the emboidment shown in FIG. 3 the current conductor is formed within the housing 2 by a conducting strip 1 and without the housing by a round conductor 9, said conductors being connected with each other by soldering or by means of a plug connector in a position including an angle of approximately 90° with the location of the joint being enclosed by the pivoting nipple 7. The pivot bearing 8 consists of a sleeve located in the area of the wall of the housing 2 and projecting through the bottom of the housing, said sleeve being provided with a slot 10 forming a lateral opening toward the inside the housing and having a width permitting the rotation of the pivoting nipple 7 by a predetermined angle. The pivoting nipple 7 is equipped with a circumferential groove and the pivot bearing 8 with a shoulder projection 11 projecting into said groove, whereby the secure holding and the guidance of the pivoting nipple is assured, while maintaining the necessary freedom of rotation.

We claim:

1. A vehicle steering current conducting device comprising:

a current conductor wound a plurality of times in an area between a fixed housing and a centrally arranged steering wheel shaft;

means for connecting an inner end of said current conductor, mounted on and arranged to rotate with the shaft;

means for connecting an outer end of said current conductor associated with the fixed housing comprising a first pivot bearing arranged on and fixed to the fixed housing, a pivotable spindle rotatably arranged within said pivot bearing, wherein said outer end of said current conductor extends in a radial fashion to said pivotable spindle and exhibits an axially extending outer terminal.

2. A device according to claim 1, wherein said pivotable spindle exhibits a circumferential groove and said pivot bering exhibits a shoulder projection protruding into said groove.

3. A device according to claim 1, wherein said means for connecting an inner end of said current conductor comprises a second pivot bearing arranged on and fixed to said shaft, a second pivotable spindle rotatably arranged within said second pivot bearing wherein said inner end of said current conductor extends in a radial fashion to said second pivotable spindle and exhibits an axially extending inner terminal.

4. A device according to claim 1, wherein said first pivot bearing comprises a circular sleeve, formed integrally with said fixed housing, and exhibiting an inwardly directed slot defining an angle of rotation of said pivotable spindle.

5. A device according to claim 1, wherein said current conductor is a conducting strip and wherein said outer end exhibits a loop, effecting a right angle transition to said outer terminal, embedded in said first pivotable spindle.

6. A device according to claim 5, wherein said first pivot bearing comprises a circular sleeve, formed integrally with said fixed housing, and exhibiting an inwardly directed slot defining an angle of rotation of said pivotable spindle.

7. A device according to claim 5, wherein said pivotable spindle exhibits a circumferential groove and said pivot bearing exhibits a shoulder projection protruding into said groove.

8. A device according to claim 5, further comprising a rounded conductor connected to said outer terminal within said first pivotable spindle.

9. A device according to claim 8, wherein said pivotable spindle exhibits a circumferential groove and said pivot bearing exhibits a shoulder projection protruding into said groove.

10. A device according to claim 8, wherein said first pivot bearing comprises a circular sleeve, formed integrally with said fixed housing, and exhibiting an inwardly directed slot defining an angle of rotation of said pivotable spindle.

11. A device according to claim 10, wherein said pivotable spindle exhibits a circumferential groove and said pivot bearing exhibits a shoulder projection protruding into said groove.

* * * * *